US006461279B1

(12) United States Patent
Kuo

(10) Patent No.: US 6,461,279 B1
(45) Date of Patent: Oct. 8, 2002

(54) TREADMILL HAVING DUAL TREADS FOR STEPPING EXERCISES

(76) Inventor: Hai Pin Kuo, No. 15, Lane 833, Wen Hsien Road, Tainan City (TW), 704

( * ) Notice: Subject to any disclaimer, the term of this patent is extended or adjusted under 35 U.S.C. 154(b) by 0 days.

(21) Appl. No.: 09/912,664

(22) Filed: Jul. 25, 2001

(51) Int. Cl.[7] ..... A63B 22/02
(52) U.S. Cl. ..... 482/54; 482/52
(58) Field of Search ..... 482/51–54, 71, 482/72, 74, 111, 112; 104/25; 198/324, 817

(56) References Cited

U.S. PATENT DOCUMENTS 5,336,146 A 8/1994 Piaget et al. ..... 482/54
5,669,856 A * 9/1997 Liu ..... 482/51
2001/0016542 A1 * 8/2001 Yoshimura ..... 482/54

* cited by examiner

*Primary Examiner*—Stephen R. Crow
*Assistant Examiner*—Tam Nguyen
(74) *Attorney, Agent, or Firm*—Charles E. Baxley

(57) ABSTRACT

A treadmill device includes two treadmills disposed above a base and each having a tread supported around a platform and each has one end rotatably supported on the base with a shaft which may be driven by a motor. An arm has a middle portion pivotally supported on the base and has two ends located below and coupled to the treadmills, for elevating one of the treadmills when the other treadmill is lowered, such that the two treadmills may be operated as a stepping exerciser. A latch may be used to lock the treadmills together.

5 Claims, 14 Drawing Sheets

TREADMILL HAVING DUAL TREADS FOR STEPPING EXERCISES

BACKGROUND OF THE INVENTION

1. Field of the Invention

The present invention relates to a treadmill apparatus, and more particularly to a treadmill apparatus having dual treads for conducting both jogging and stepping exercises.

2. Description of the Prior Art

U.S. Pat. No. 5,336,146 to Piaget et al. discloses one of the typical treadmills including dual treads that may be alternatively pivot up and down as a user walks thereon. However, Piaget et al. fail to disclose a coupling device for coupling the two treads together, due to the continuous treads.

The present invention has arisen to mitigate and/or obviate the afore-described disadvantages of the conventional treadmills.

SUMMARY OF THE INVENTION

The primary objective of the present invention is to provide a treadmill apparatus including dual treads for conducting both jogging and stepping exercises.

In accordance with one aspect of the invention, there is provided a treadmill apparatus comprising a base including a first end, and including a second end having a shaft provided thereon, a pair of treadmills disposed above the base, and each including a platform having a roller provided on a first end thereof and attached to the shaft, and each including a tread supported around the platform, means for driving the shaft to actuate the treads, an arm including a middle portion pivotally supported on the base with a pivot axle, and including two ends located below the treadmills respectively, and means for coupling the ends of the arm to the treadmills to elevate a first of the treadmills when a second of the treadmills is lowered, and to elevate the second treadmill when the first treadmill is lowered. The treadmills may thus be moved up and down relative to each other by the arm, and may thus be actuated as a stepping exerciser.

The treadmills each includes a bar attached to the platform thereof and extended downward from the platform for coupling to the ends of the arm respectively.

The ends of the arm each includes a rod provided therein and perpendicular to the arm, and a column pivotally secured to the respective rod, the treadmills each includes a bar attached to the platform thereof and coupled to the column respectively.

A device may further be provided for locking the treadmills together.

A device is further provided for retaining the treads on the platforms respectively and for preventing the treads from being disengaged from the platforms.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
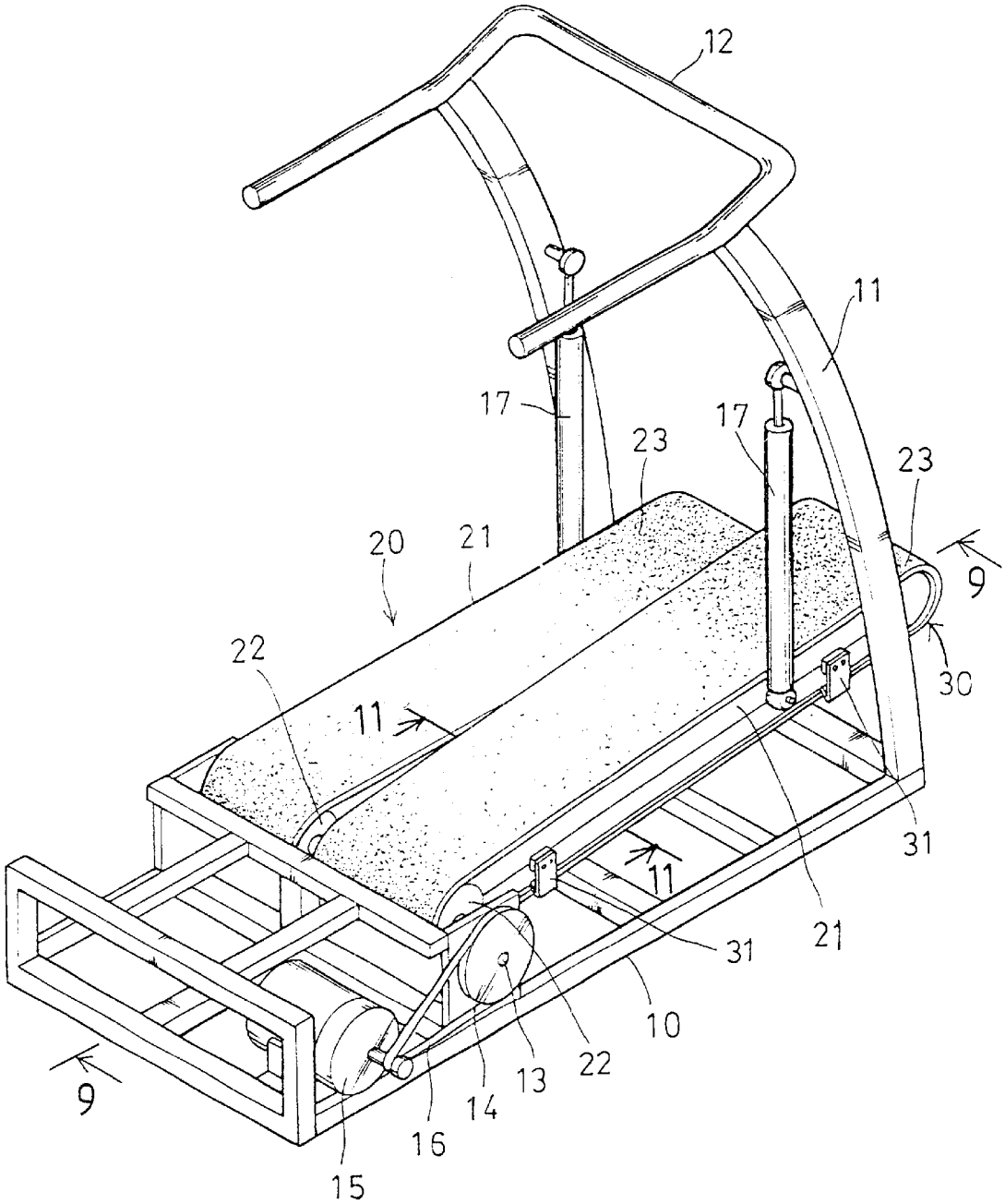
FIG. 1 is a perspective view of a treadmill apparatus in accordance with the present invention.
Figure 2:
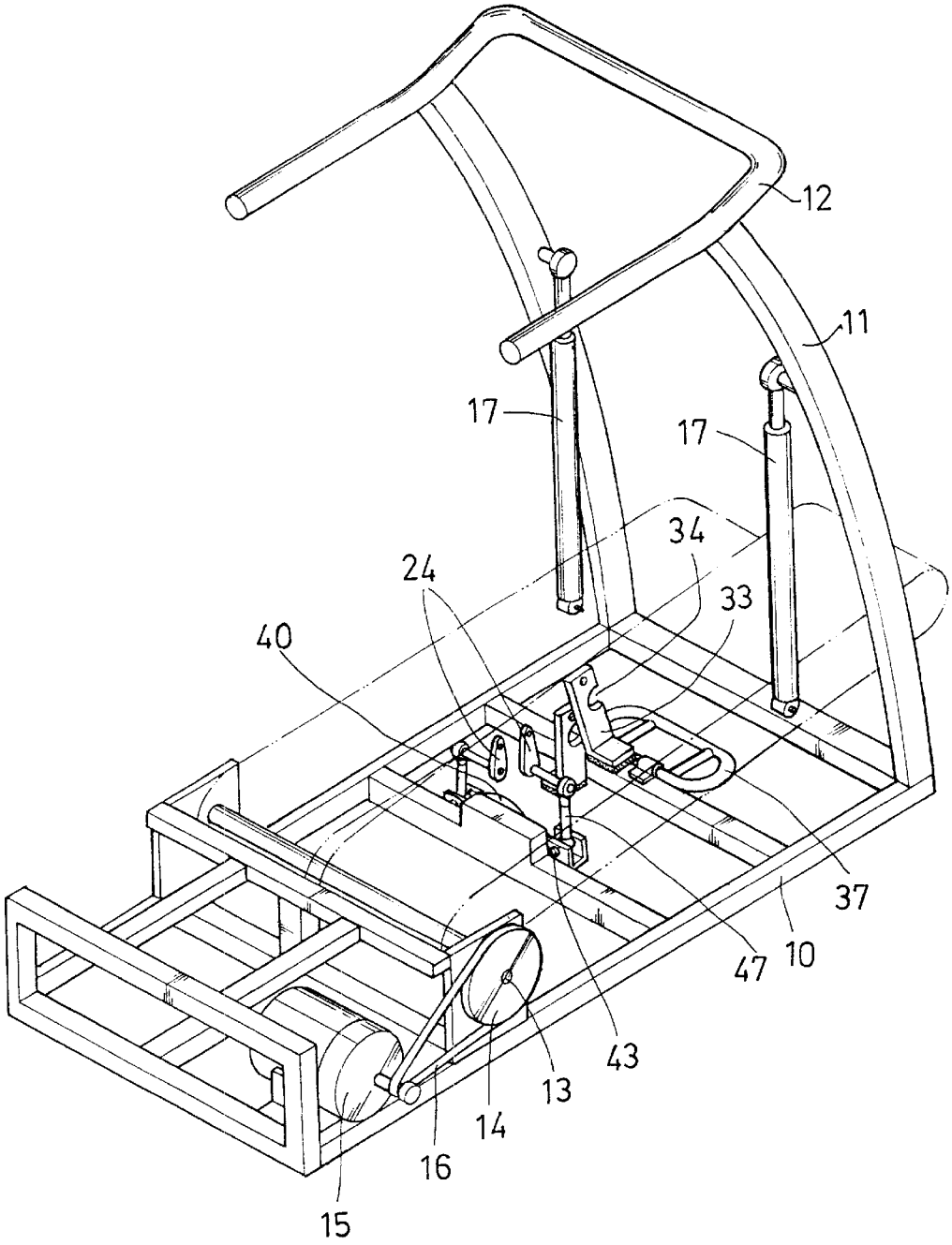
FIG. 2 is a perspective view of the treadmill apparatus, in which the two treads are removed for showing the inner structure of the treadmill apparatus.
Figure 3:
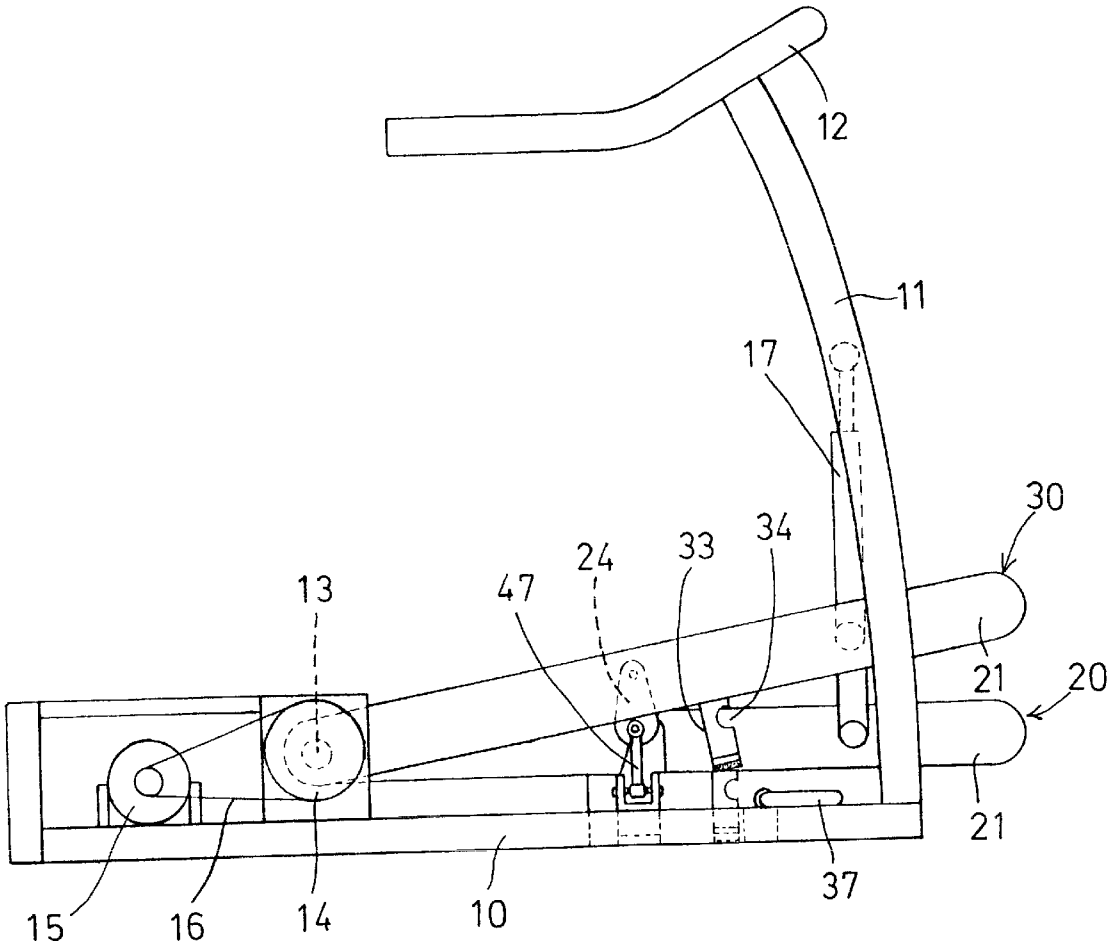
FIGS. 3 and 4 are side plane views illustrating the operation of the treadmill apparatus.
Figure 4:
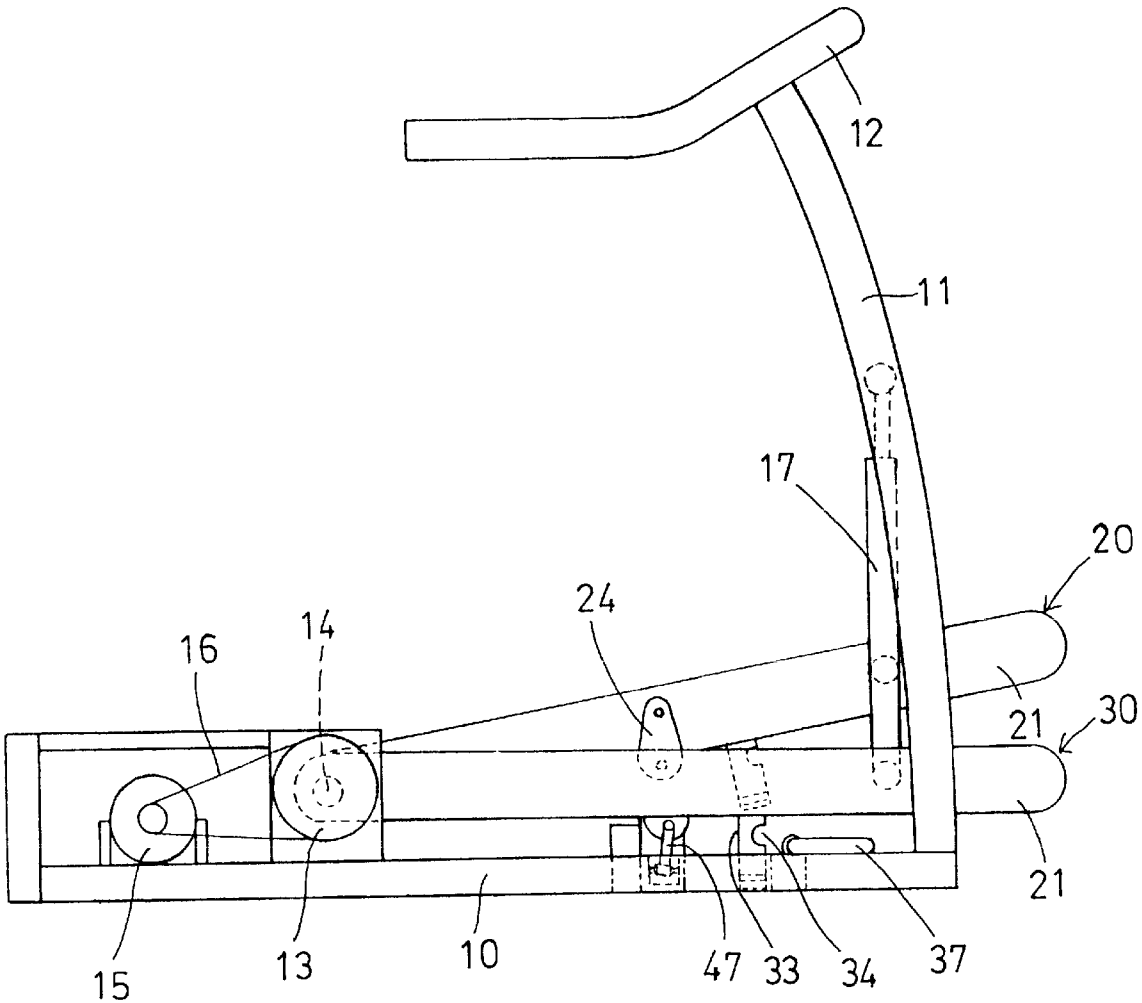
Figure 5:
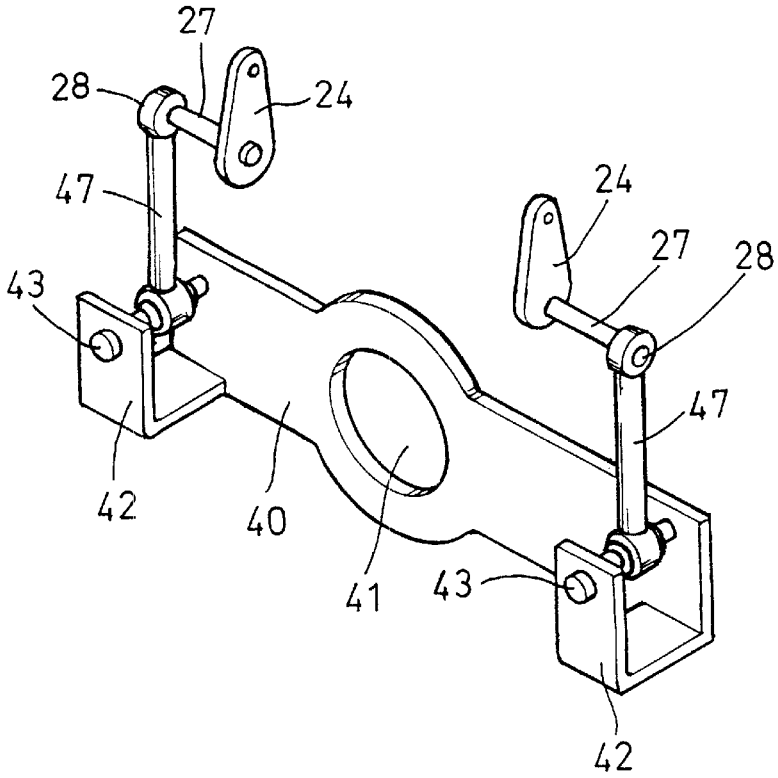
FIG. 5 is a partial perspective view illustrating a coupling device for coupling the treads of the treadmill apparatus together.
Figure 6:
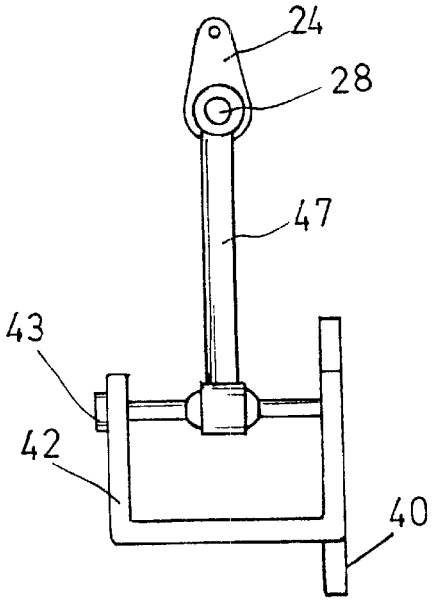
FIG. 6 is a cross sectional view taken along lines 6—6 of FIG. 5.

Referring to the drawings. and initially to FIGS. 1–4, a treadmill apparatus in accordance with the present invention comprises a base 10 including one or more posts 11 extended upward therefrom, such as extended upward from the front portion thereof, and including one or more handles 12 provided on top of the posts 11, and including a shaft 13 rotatably provided on the middle or the rear portion thereof. A wheel 14 or the like is secured to the shaft 13 and rotated in concert with the shaft 13. A motor 15 is disposed on the base 10 and coupled to the wheel 14 and/or the shaft 13 with a transmission device 16, such as a pulley-and-belt or a sprocket-and-chain transmission device 16, such that the shaft 13 may be rotated and driven by the motor 15.

A pair of treadmills 20, 30 are identical in construction, and each preferably includes a rigid treadmill platform 21 having a front end and a rear end, rollers 22 rotatably mounted at each of the front end and the rear end of the platform 21, and a continuous tread 23 extended around the platform 21 and rotatably supported on or around the rollers 22. The rollers 22 may be secured on the shaft 13, such that the rollers 22 and thus the treads 23 may be rotated or driven by the motor 15, and such that the treadmills 20 pivotally mounted on the base 10 in side-by-side adjacent relation by the shaft 13. The rollers 22 may also be separately coupled or secured on the shaft 13 by gearing transmission or the like, for allowing the treads 23 of the two treadmills 20 to be driven separately by the motor 15. Two spring-return hydraulic cylinders or actuators 17 are coupled between the posts 11 and the treadmills 20 respectively for supporting the treadmills 20, such as the front ends of the treadmills 20 in an inclined position. The actuators 17, and/or the construction of the treadmills 20 is considered to be conventional in the art, and therefore no further description is thought to be necessary.

As shown in FIGS. 2–10, the treadmill apparatus in accordance with the present invention further comprises a coupling device for coupling the treadmills together and for allowing the treadmills to be conducted with a stepping exercise. The coupling device includes an arm 40 having an orifice 41 formed in the middle portion thereof (FIGS. 5, 7, 8), for receiving a pivot axle 18 which may rotatably or pivotally securing the arm 40 to the base 10, and for allowing the ends of the arm 40 to be moved; up and down and to be disposed below the treadmills 20, 30 respectively. The ends of the arm 40 each includes a frame 42 provided therein for supporting a rod 43 therein which is about parallel to the longitudinal direction of the base 10 and of the treadmills 20, 30 and which is perpendicular to the arm 40.

Two columns 47 have the lower portions pivotally or rotatably secured onto the respective rods 43 with such as a universal joint or the like. The treadmills 20 each includes a bar 24 secured to the middle portion of the platform 21 thereof and extended downward therefrom and having a lower end pivotally or rotatably secured to the upper end of the column 47 with a rod 27 and a joint 28, such as a universal joint or the like. The treadmills 20 thus may be coupled to the ends of the arm 40 with the bars 24, the rods 27, the joints 28, the columns 47, the pivot rods 43, and the frames 42.

Figure 7:
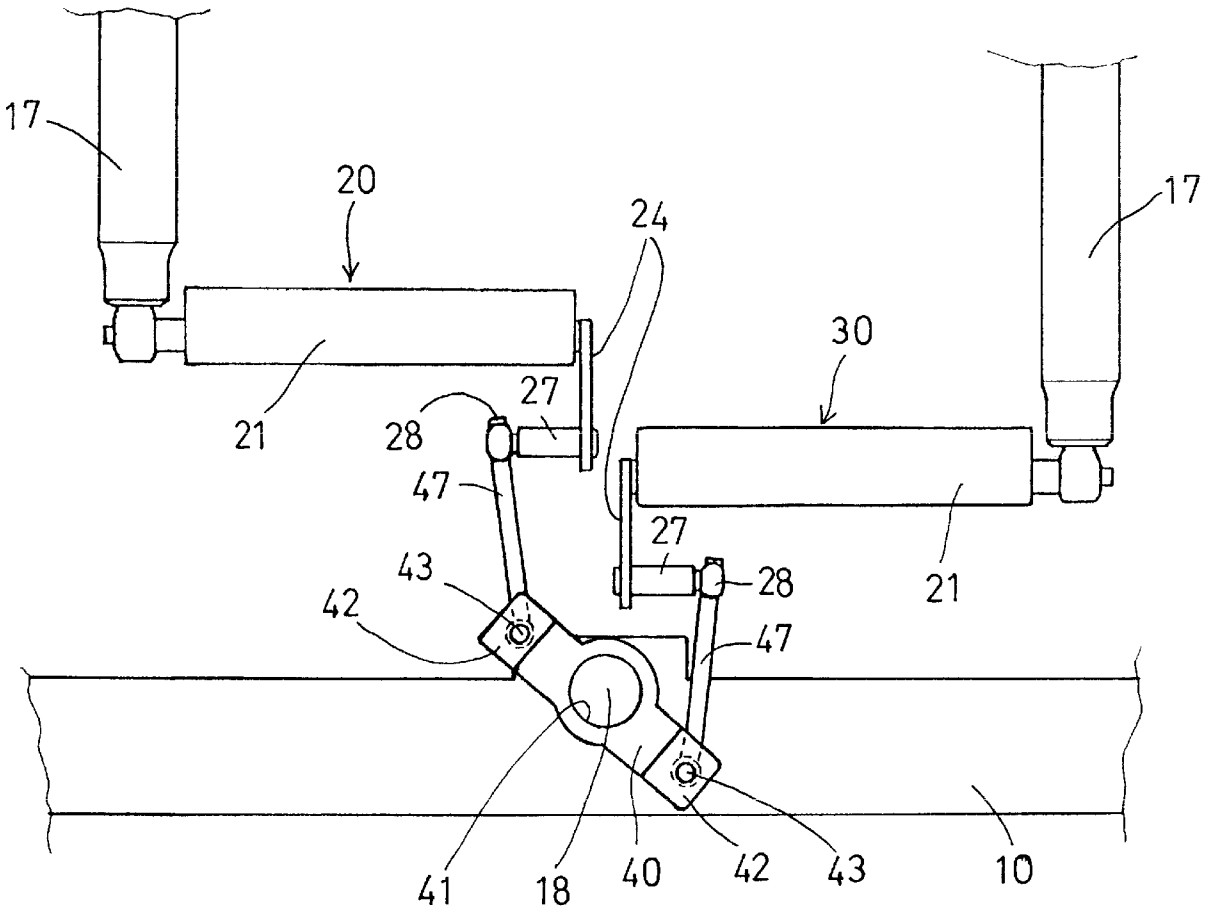
FIGS. 7 and 8 are partial end schematic views illustrating the operation of the treadmill apparatus.
Figure 8:
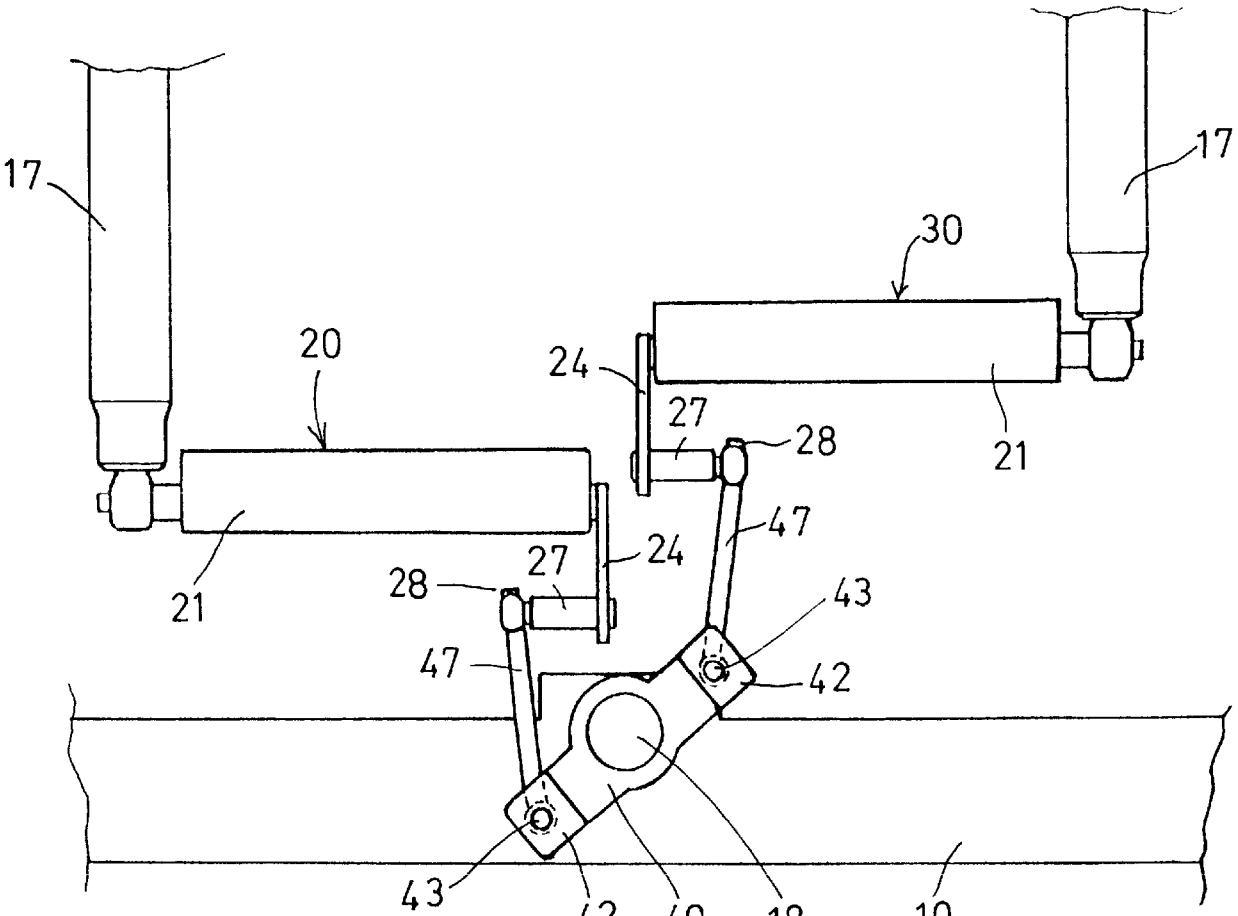
Figure 9:
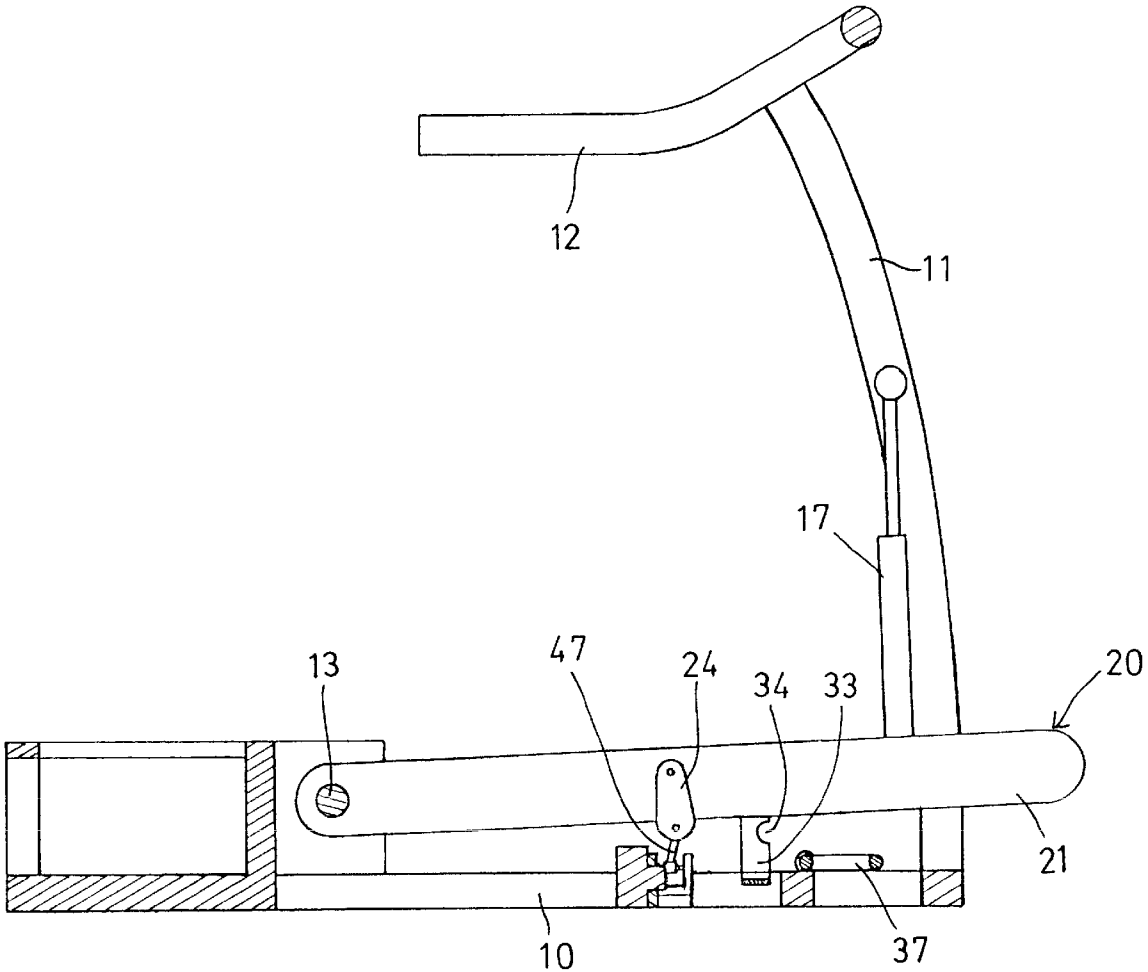
FIG. 9 is a cross sectional view taken along lines 9—9 of FIG. 1.
Figure 10:
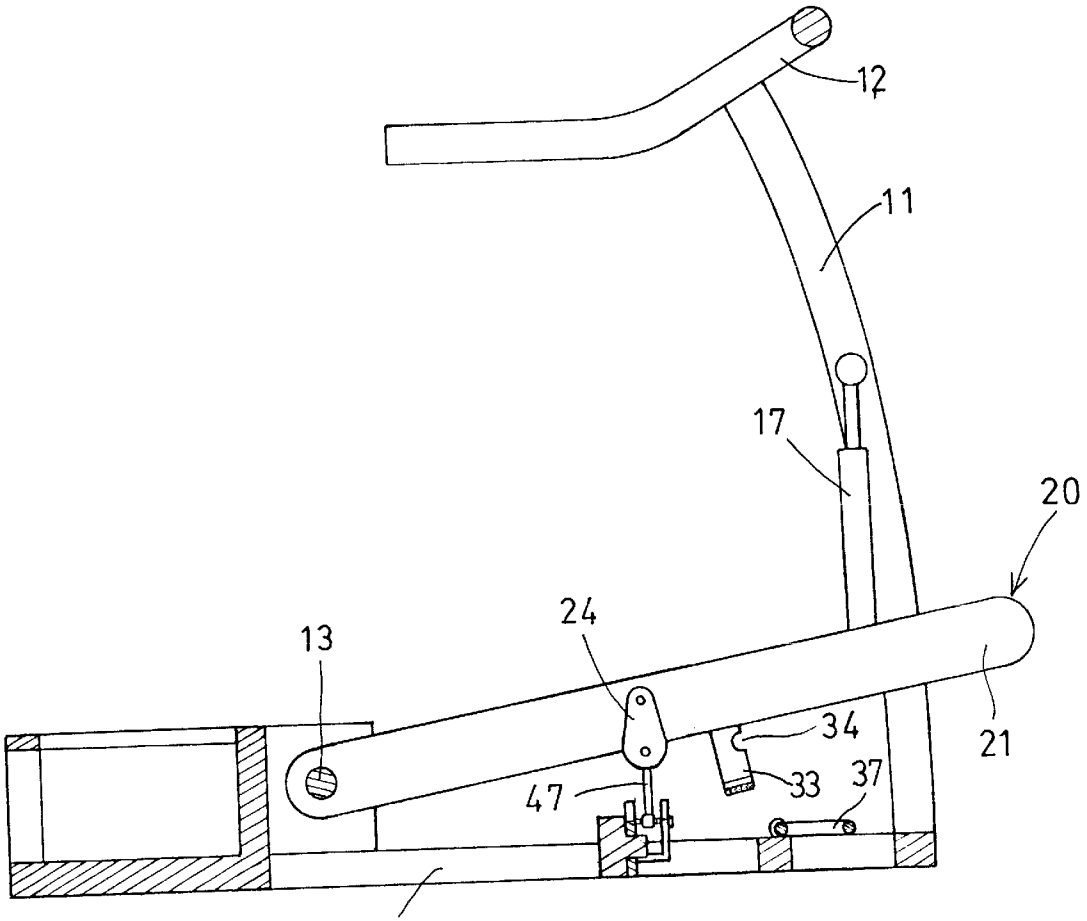
FIG. 10 is a cross sectional view similar to FIG. 9, illustrating the operation of the treadmill apparatus.

In operation, as shown in FIGS. 7 and 8, when one of the treadmills 20 is depressed downward by the user (FIG. 8), the other treadmill 30 will be moved upward by the arm 40. On the contrary, when the treadmill 30 is depressed downward by the user (FIG. 7), the other treadmill 20 will be moved upward by the arm 40, such that the treadmills 20, 30 may be actuated or operated as the stepping exercisers.

Figure 11:
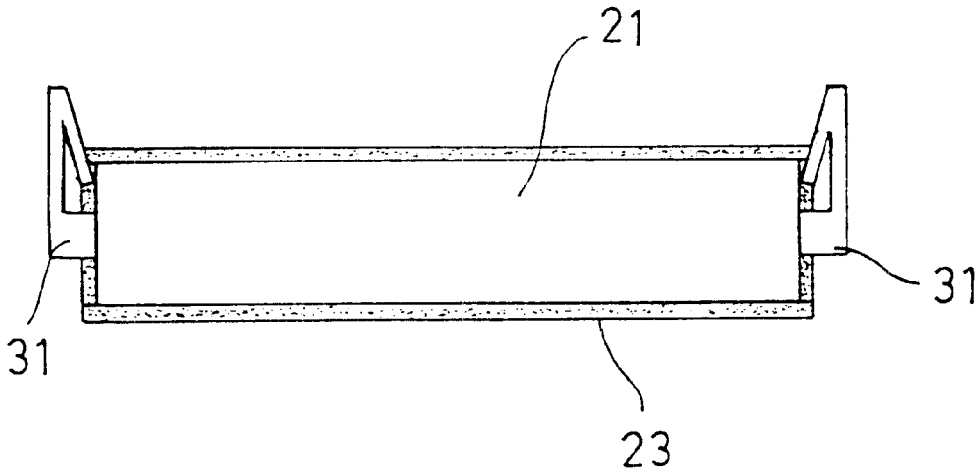
FIG. 11 is a partial cross sectional view taken along lines 11—11 of FIG. 1.

Referring next to FIGS. 1 and 11, the treadmills 20, 30 each includes one or more stops 31 attached to the side portions of the platforms 21 and engaged with the treads 23, for stably retaining the treads 23 within the platforms 21 respectively, and for preventing the treads 23 from being disengaged from the platforms 21 respectively.

Figure 12:
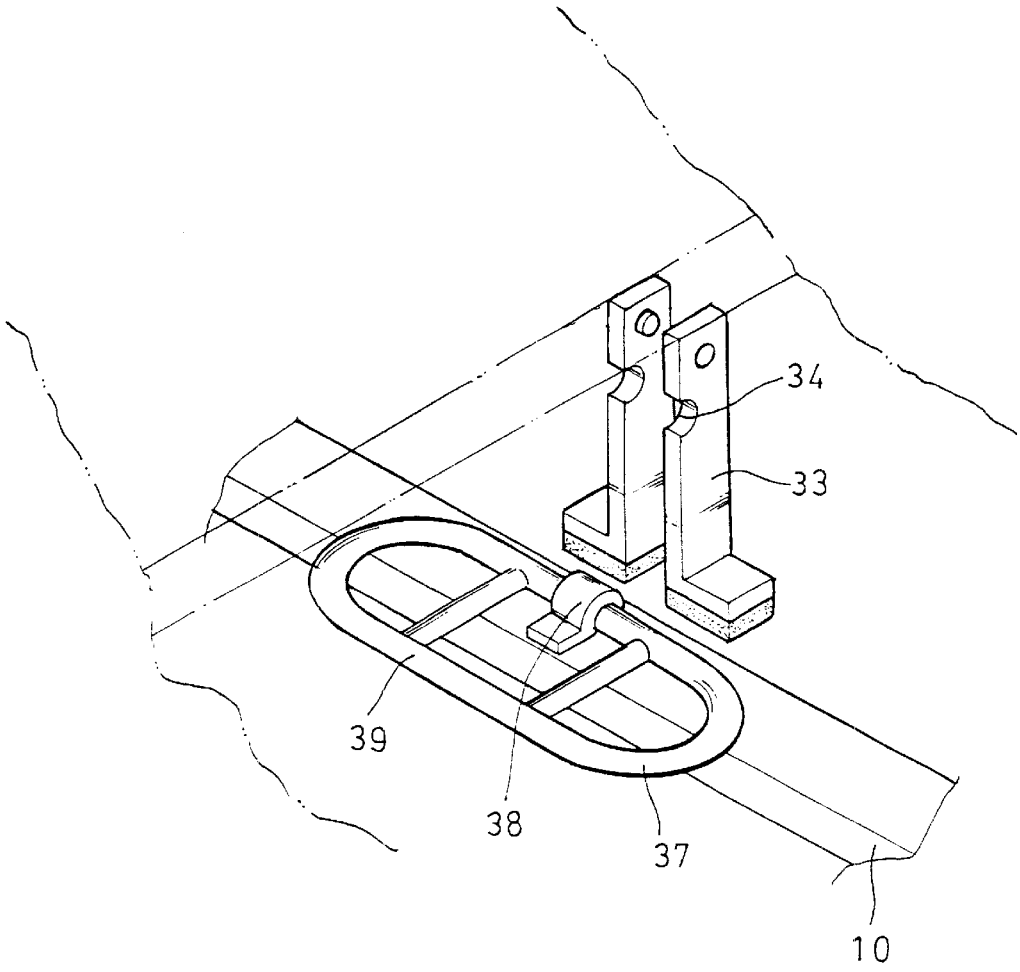
FIG. 12 is a partial perspective view of the treadmill apparatus.
Figure 13:
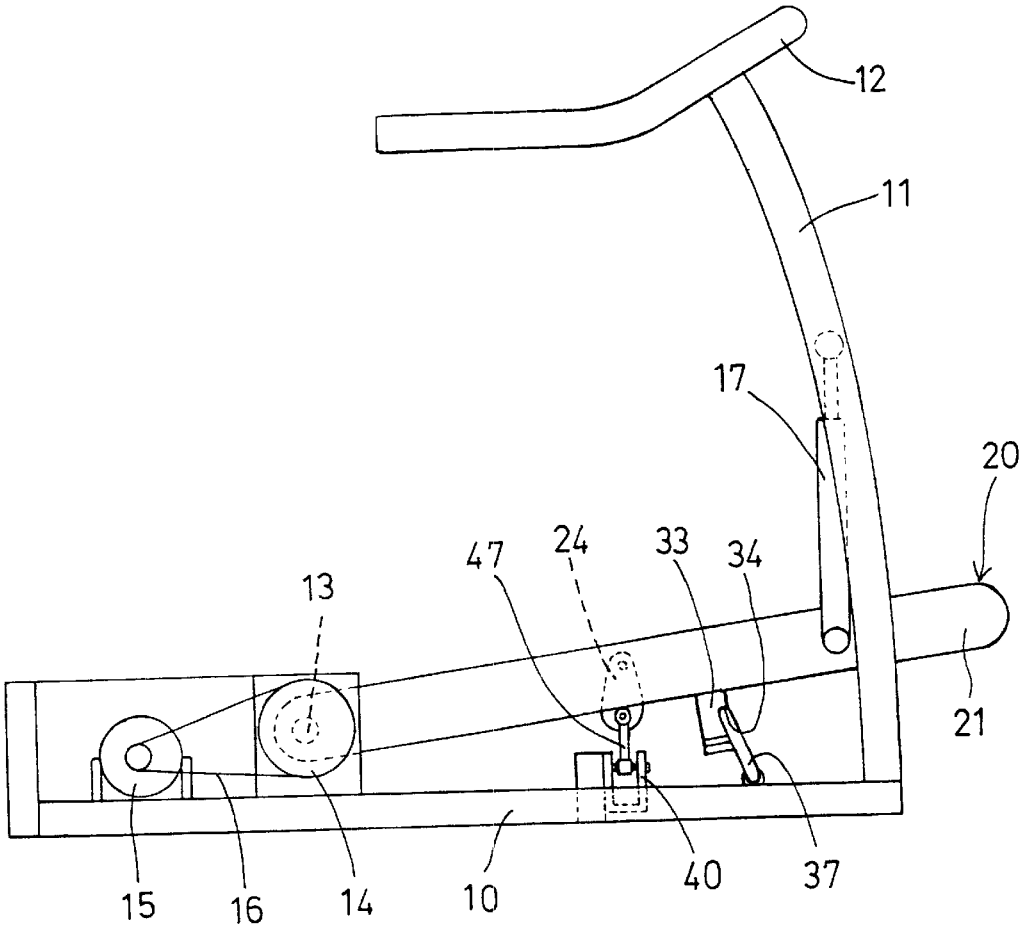
FIG. 13 is a side plane schematic view illustrating the device for locking the two treads of the treadmill apparatus.

Referring next to FIGS. 12 and 13, the treadmills 20, 30 each further includes an extension 33 extended downward therefrom, such as extended downward from the platform 21 thereof. The extensions 33 each includes a notch 34 formed therein. A retaining or locking or latching device 37 is pivotally coupled to or secured to the base 10 with a bracket 38 or the like, and includes a lock member or a latch 39 for engaging into the notches 34 of the extensions 33 and for locking the treadmills 20, 30 together, such that the treadmills 20, 30 may not be moved up and down relative to each other and may be used for conducting the treadmill exercises only.

Figure 14:
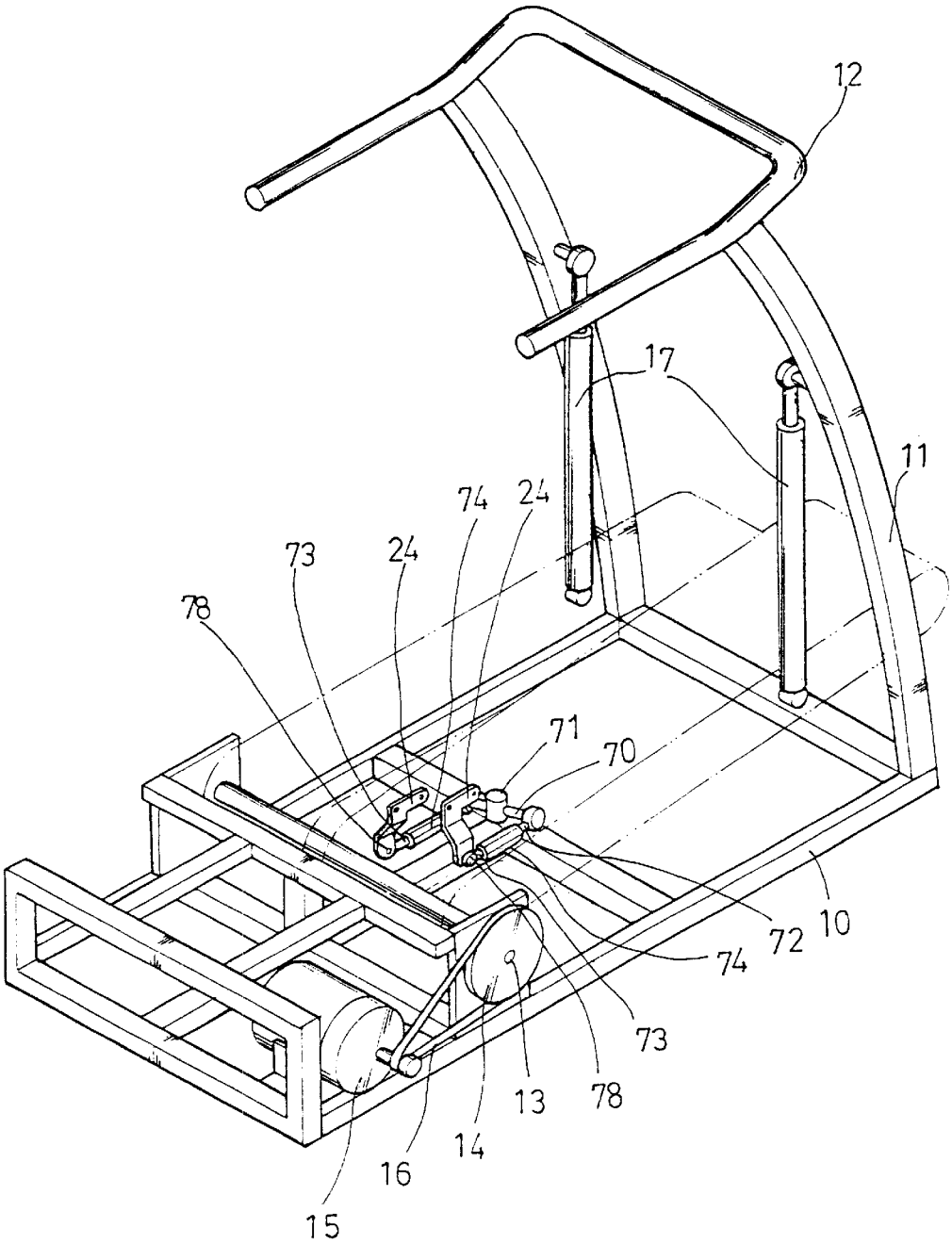
FIG. 14 is a perspective view similar to FIG. 2, illustrating the other embodiment of the treadmill apparatus.
Figure 16:
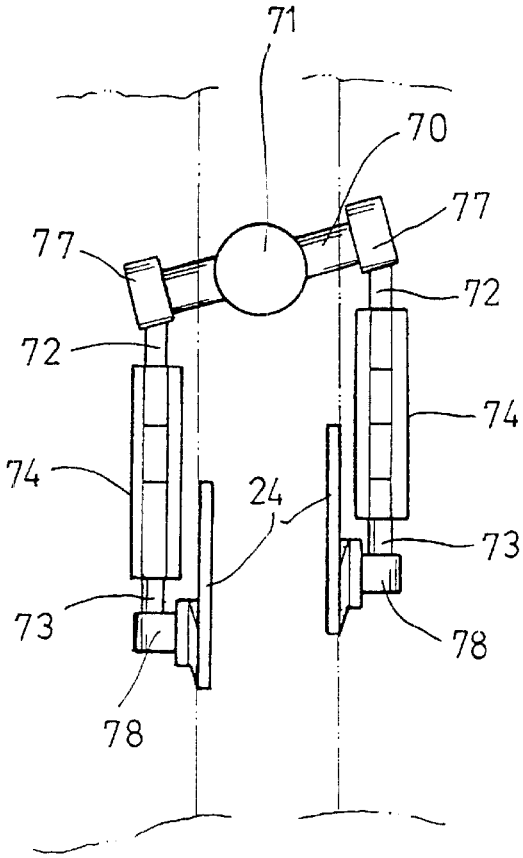
FIG. 16 is a partial top plane schematic view of the treadmill apparatus as shown in FIGS. 14 and 15.
Figure 15:
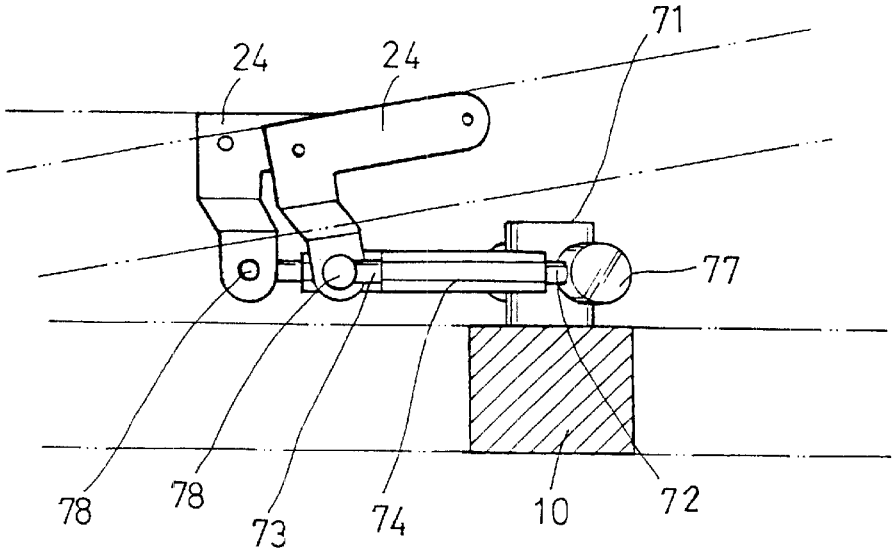
FIG. 15 is a partial side plane schematic view of the treadmill apparatus as shown in FIG. 14.

Referring next to FIGS. 14–16, illustrated is another embodiment of the coupling device which also, includes an arm 70 rotatably secured to the base 10 with a pivot axle 71. However, the ends of the arm 70 may be moved forward and rearward, instead of being moved up and down as that shown in FIGS. 2–10. Two pairs of bolts 72, 73 are pivotally secured to the ends of the arm 70 and to the bars 24 with a joint, such as a universal joint 24 respectively. A longitudinal nut 74 is threaded onto the pair of bolts 72, 73 for moving or adjusting the bolts 72, 73 toward or away from each other and for adjusting the bars 24 relative to the arm 70, according to the configuration or the location of the treadmills 20, 30.

Accordingly, the treadmill apparatus in accordance with the present invention includes dual treads for conducting both jogging and stepping exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A treadmill apparatus comprising:

a base including a first end, and including a second end having a shaft provided thereon, a pair of treadmills disposed above said base, and each including a platform having a roller provided on a first end thereof and attached to said shaft, and each including a tread supported around said platform, means for driving said shaft to actuate said treads, an arm including a middle portion pivotally supported on said base with a pivot axle, and including two ends located below said treadmills respectively, and means for coupling said ends of said arm to said treadmills to elevate a first of said treadmills when a second of said treadmills is lowered, and to elevate said second treadmill when said first treadmill is lowered.

2. The treadmill apparatus according to claim 1, wherein said treadmills each includes a bar attached to said platform thereof and extended downward from said platform for coupling to said ends of said arm respectively.

3. The treadmill apparatus according to claim 1, wherein said ends of said arm each includes a rod provided therein and perpendicular to said arm, a column pivotally secured on said rod respectively, said treadmills each includes a bar attached to said platform thereof and coupled to said column respectively.

4. The treadmill apparatus according to claim 1 further comprising means for locking said treadmills together.

5. The treadmill apparatus according to claim 1 further comprising means for retaining said treads on said platforms respectively.

* * * * *

UNITED STATES PATENT AND TRADEMARK OFFICE

CERTIFICATE OF CORRECTION

PATENT NO. : 6,461,279 B1
APPLICATION NO. : 09/912664
DATED : October 8, 2002
INVENTOR(S) : Hai Pin Kuo It is certified that error appears in the above-identified patent and that said Letters Patent is hereby corrected as shown below:

Title page, Item (76), "Inventor", insert --Gary D. Piaget, 141 Deep Meadow Lane, Deer Harbor, Washington 98243--.

Signed and Sealed this

Second Day of December, 2008

JON W. DUDAS
*Director of the United States Patent and Trademark Office*